US009953496B2

(12) United States Patent
Westman et al.

(10) Patent No.: US 9,953,496 B2
(45) Date of Patent: Apr. 24, 2018

(54) ELONGATED WIRELESS SENSOR ASSEMBLY

(71) Applicant: Sensative AB, Lund (SE)

(72) Inventors: Fredrik Westman, Lund (SE); Anders Hedberg, Lund (SE)

(73) Assignee: Sensative AB, Lund (SE)

( * ) Notice: Subject to any disclaimer, the term of this patent is extended or adjusted under 35 U.S.C. 154(b) by 0 days.

(21) Appl. No.: 15/023,085

(22) PCT Filed: Sep. 19, 2014

(86) PCT No.: PCT/EP2014/069959
§ 371 (c)(1),
(2) Date: Mar. 18, 2016

(87) PCT Pub. No.: WO2015/040144
PCT Pub. Date: Mar. 26, 2015

(65) Prior Publication Data

US 2016/0232762 A1 Aug. 11, 2016

(30) Foreign Application Priority Data

Sep. 19, 2013 (SE) ..... 1351088

(51) Int. Cl.
*G08B 13/24* (2006.01)
*G08B 13/08* (2006.01)
(Continued)

(52) U.S. Cl.
CPC ..... *G08B 13/08* (2013.01); *G08B 13/1895* (2013.01); *G08B 13/24* (2013.01);
(Continued)

(58) Field of Classification Search
CPC ..... G08B 13/00; G08B 13/02; G08B 13/08; G08B 13/22; G08B 13/24;
(Continued)

(56) References Cited

U.S. PATENT DOCUMENTS

2005/0024207 A1* 2/2005 Schebel ..... G08B 13/08 340/545.2
2005/0068176 A1 3/2005 Ko
(Continued)

FOREIGN PATENT DOCUMENTS

DE 202009004527 6/2009
GB 2356077 3/2005

OTHER PUBLICATIONS

International Search Report and Written Opinion for co-pending international application Serial No. PCT/EP2014/069959, dated Nov. 27, 2014.

*Primary Examiner* — Benyam Haile
(74) *Attorney, Agent, or Firm* — Dinsmore & Shohl LLP

(57) ABSTRACT

A sensor assembly as part of a wireless alarm system for building entrances like windows and doors. An elongated sensor assembly for detecting a change of state comprising at least one sensor switch configured to detect a given state and a change of state between the given state and at least one other state, a microprocessor configured to detect the change of state of the at least one sensor switch, an antenna system, a wireless transmitter configured to receive a signal from the microprocessor identifying a change of the state of the at least one sensor switch and transmit the signal by means of the antenna system, and a power source for providing electric power, wherein the at least one sensor switch, the microprocessor, the antenna system, the wireless transmitter, and the power source are incorporated in the elongated sensor assembly having a maximum height of less than 5 mm.

25 Claims, 9 Drawing Sheets

(51) Int. Cl.

| | |
|---|---|
| ***H01H 36/00*** | (2006.01) |
| ***G08B 13/189*** | (2006.01) |
| *G08B 13/00* | (2006.01) |
| *H01H 3/00* | (2006.01) |

(52) U.S. Cl.
CPC .... *H01H 36/0006* (2013.01); *H01H 36/0033* (2013.01); *G08B 13/00* (2013.01); *H01H 3/00* (2013.01); *H01H 36/00* (2013.01)

(58) Field of Classification Search
CPC ..... E05B 2047/0068; G06F 1/3296; H01H 36/00; H01H 2036/00; H01H 3/00; H01H 3/02; H01H 3/16; H01H 3/161; H01H 3/162; H01H 3/163; H01H 3/18; H01H 50/16; H01H 9/02
See application file for complete search history.

(56) References Cited

U.S. PATENT DOCUMENTS

| | | | | |
|---|---|---|---|---|
| 2005/0195101 | A1* | 9/2005 | Stevens | G01S 13/56 342/28 |
| 2006/0210104 | A1* | 9/2006 | Shennib | H04R 25/00 381/315 |
| 2009/0231774 | A1* | 9/2009 | Owen | H01H 51/28 361/152 |
| 2012/0268274 | A1* | 10/2012 | Wieser | G08B 13/08 340/545.2 |
| 2014/0247128 | A1* | 9/2014 | Young | G08B 3/10 340/541 |

* cited by examiner

PRIOR ART

ELONGATED WIRELESS SENSOR ASSEMBLY

CROSS-REFERENCE TO RELATED APPLICATIONS

This application is the U.S. national stage of PCT/EP2014/069959 filed Sep. 19, 2014, which claims priority of Swedish Patent Application No. 1351088-8 filed Sep. 19, 2013.

FIELD OF THE INVENTION

The present disclosure relates to a sensor assembly as part of a wireless alarm system or smart home system for building entrances like windows and doors. The present disclosure further relates to an alarm kit and an alarm system comprising the herein disclosed sensor assembly.

BACKGROUND OF THE INVENTION

Illegal intrusion and burglary is a threat to nearly all property owners or occupiers. Therefore, the alarm systems are being installed in increasing numbers all over the world. Many building entrances, such as windows and doors are retrofitted with the intrusion alarm systems. Although these systems are primarily intended to detect breech and illegal entry, these can also detect entrants at the open building entrances.

Security sensors, which detect a change of state when a door or window has been opened during an unauthorized time, or in some other unauthorized conditions, have routinely been used as part of alarm systems. Intrusion of a door or window can be detected by a break in an electromagnetic circuit using a device, such as a reed switch, installed in one portion of the window or door and a magnet installed in an adjacent position in the other corresponding portion of the window or door. A typical retrofitted wireless window alarm kit comprises a sensor assembly mounted visibly on the door frame and an actuation element (typically a magnet) mounted on the window flush with the sensor assembly when the window is closed.

U.S. Pat. No. 7,081,816 discloses a wireless security sensor system with a wireless sensor assembly adapted to be retrofitted into a hollow interior of a window or door frame. An actuation unit in the form of a magnet assembly is inserted flush with the sensor into the hollow interior of the corresponding window or door. The sensor and magnet assemblies are hidden within the frame and window, respectively, and thereby not readily seen by an intruder. However, both the sensor assembly and the magnet assembly require 1 inch diameter bore holes in the door/window and in the corresponding frame. Also, a long wire antenna extends from the button shaped assembly housing.

U.S. Pat. No. 5,083,110 discloses a window alarm system with a plurality of small, self-contained thin, elongated units strategically located on a window. The units are either spring-controlled or transducer-controlled, and are set to activate an alarm upon the application of a predetermined amount of pressure thereto, e.g. when an intruder presses/touches one of the self-contained units. This type of alarm is not activated upon movement of a window/door.

SUMMARY OF THE INVENTION

One purpose of the present invention is to provide a wireless intrusion alarm kit that can be retrofitted noninvasively to existing building entrances, e.g. windows and doors, which is invisible to intruders and is not immediately visible to the occupants, i.e. a sensor assembly that is easy to install, preferably without requiring tools and impairing the design aesthetics of a home. One embodiment of the present disclosure has an elongated sensor assembly for detecting a change of state comprising at least one sensor switch configured to detect a given state and a change of state between the given state and at least one other state, a microprocessor configured to detect the change of state of said at least one sensor switch, an antenna system, a wireless transmitter configured to receive a signal from the microprocessor identifying a change of the state of the at least one sensor switch and transmit said signal by means of the antenna system, and a power source for providing electric power to the microprocessor, the at least one sensor switch, the antenna system and the wireless transmitter, wherein said at least one sensor switch, said microprocessor, said antenna system, said wireless transmitter, and said power source are incorporated in said elongated sensor assembly to reach a maximum height of the sensor assembly of less than 5 mm.

The abovementioned sensor assembly may be part of an alarm kit and/or a wireless alarm system. The wireless alarm system may comprise one or more of said elongated sensor assemblies, and a wireless receiver configured to receive and process signals transmitted from said one or more sensor assemblies. The alarm kit may comprise the abovementioned elongated sensor assembly and at least one actuation unit for actuating the sensor switch. The wireless alarm system comprising one or more of the abovementioned window alarm kits and a wireless receiver configured to receive and process signals transmitted from the sensor assemblies of said one or more window alarm kits.

For doors, casement windows and awning windows, the proofing and sealing surfaces function as an isolation barrier and are disposed between the closed door/window and the corresponding frame and are also typically in a plane parallel with the window plane. Many windows and doors therefore have narrow, elongated voids and cavities extending along the sides of the window and the corresponding frame. When the door/window is closed, these voids and cavities are formed behind or between the isolation barriers of the window. In some cases, these voids and cavities form part of the isolating capacities of the window, especially with double-glazed windows. However when the sash window is closed, it may have narrow elongated voids and cavities between the sash and the frame.

If a sensor assembly is built with a slim, elongated form factor, the sensor assembly for a wireless alarm system may be installed in these voids and cavities. Due to the slim, elongated form factor the sensor assembly may be placed there without modification to the window or frame, and may be hidden by the window frame and window when the window is in a closed position. This feature is advantageous as a user does not have to pierce the surfaces in windows and frames, which might cause decreased insulation properties, break the water seal provided by the manufacturers and may void the warranties of the windows. Doors, windows and frames may be partly manufactured in metal or plastics, e.g. with metals edgings, which makes it difficult to penetrate a metal surface to install a sensor assembly, e.g. as seen in U.S. Pat. No. 7,081,816. Piercing these surfaces, wherein some may have a vacuum below for insulation properties of the window/door precludes inserting anything therein and even a nail or screw piercing the surface must be avoided. In general it is highly undesirable for security device manufacturers and installers to void a manufacturer's warranty. Such risks reduce the likelihood of obtaining after-market, concealed, wireless alarm systems.

The present sensor assembly and alarm kit may be provided for sash doors, awning doors, casement doors, sash windows, awning windows or casement windows, in any type of material, such as wood, metal or plastics.

DETAILED DESCRIPTION OF THE INVENTION

Figure 1:
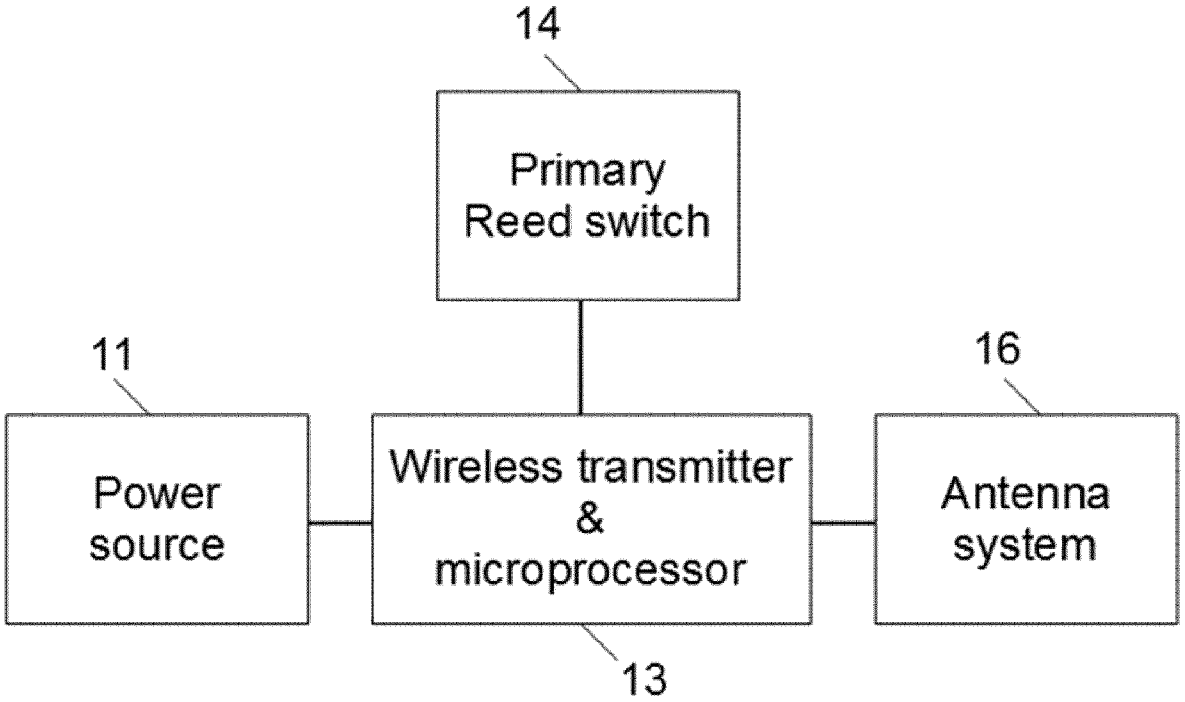
FIG. 1 shows a block diagram of an exemplary sensor assembly.

The presently disclosed sensor assembly is designed to be mounted in the voids and cavities formed between a door or window and the corresponding frame. In one embodiment of the present disclosure the elongated sensor assembly is therefore adapted to be mounted on a substantially plane surface.

The elongated sensor assembly may be mounted on a surface without penetrating the surface. The elongated sensor assembly may be mounted in an opening, void or cavity without modification of the opening, void or cavity, i.e. the physical size of the sensor assembly should not require modification to e.g. a window frame. This is especially advantageous for windows and doors with metallic parts. Furthermore, the sensor assembly does not require tools for mounting and/or installation of the assembly, thereby providing easy mounting and installation in an alarm system, thereby avoiding the use of expensive technicians. The present sensor assembly may be retrofitted (and removed without leaving traces or holes) to existing building entrances. However, in some cases it may be difficult to thoroughly fasten the sensor assembly without fastening means such as screws and nails. Thus, in a further embodiment of the invention the sensor assembly may be adapted to be mounted by means of nails or screws, preferably small screws or nails, such as pegs or pins.

Thus, in another embodiment of the present disclosure the elongated sensor assembly may be mounted on a window or window frame such that the elongated sensor assembly is located in a void formed between the window and the window frame when the window is closed. Further, the elongated sensor assembly may be mounted on a door or door frame such that the elongated sensor assembly is located in a void formed between the door and the door frame when the door is closed.

In order to fit inside these narrow elongated voids and cavities the maximum height/thickness of the sensor assembly may be kept to a minimum, i.e. preferably less than 5 mm, more preferably less than 4.5 mm, yet more preferably less than 4 mm, or less than 3.5 mm, even more preferably less than 3 mm, yet more preferably less than 2.5 mm, even more preferably less than 2 mm, possibly less than 1.5 mm or less than 1 mm.

The power source, typically in the form of a battery, is among the largest components of the sensor assembly. To reduce the height of the sensor assembly the battery may be placed besides the circuit structure, e.g. in the form of a PCB, instead of stacking it on top of the PCB. Ultrathin batteries with thickness below 0.5 mm are presently commercially available. If the sensor assembly is laminated or molded in plastic it will not add to the height. If using a container housing ultrathin thin top and bottom walls may be provided, such as stickers as top and bottom wall. The top and/or bottom sticker could then include an adhesive for mounting the sensor in the window/door. In one embodiment, the PCB or a circuit structure may form a lid of a container of the sensor assembly. As a consequence, in this embodiment the power source is placed between the PCB (or circuit structure) and the container.

The PCB with components may be height optimized by using an ultrathin PCB or a flexible circuit structure thereby achieving a circuit structure of less than 0.1 mm. Reed switches are presently commercially available down to a height of 1.27 mm (an SMD Reed switch). A pin-mounted Reed switch may be used and it may be mounted in a recess or hole in the PCB. An IC is typically on the order of 1 mm.

If the following commercially available components are used i.e. Plastic container+adhesive: 0.25 mm, PCB: 0.2 mm, sensor switch: 1.27 mm and a margin: 0.1 mm adds to a total height of 1.82 mm. This may allow for a battery height of approx. 1.5 mm, i.e. a height of the sensor assembly of less than 2 mm is practically realizable if using currently commercially available components. Even thinner components may be provided in the future allowing for even thinner sensor assemblies, i.e. below 1.5 mm, or down to 1 mm. However, even with a height of approx. 2, 3, 4 or 5 mm the present sensor assembly fits into the void and cavities of existing windows and doors. However, thinner sensor assemblies probably fit into more windows and doors.

In one embodiment of the present disclosure at least one sensor switch may be configured to detect whether a window or door is open or closed. Open/closed in this context is mutually exclusive, meaning that the window or door is to be considered either open or closed. A number of sensor switches are capable of detecting whether a door/window is open or closed e.g. magnetically activated sensors, magnetoresistive sensors, or proximity sensors.

In a further embodiment of the present disclosure at least one sensor switch may be configured to detect a change of position of an object. The object may be e.g. a part of a building entrance or an object related to a building entrance. Detecting the change of position of an object can be regarded as motion detection. Detecting motion can be done directly with a motion sensor but also indirectly by means of e.g. an accelerometer or vibration sensor. One advantage of detecting the motion of an object such as a door or window compared to detecting whether the door/window is open or closed is that detecting motion does not require fixed reference points. As an example, this makes it possible to use an alarm system for a window that is not completely closed, basically in any position. If the window moves, the alarm may be triggered. An additional advantage is an actuation unit may not be necessary when using e.g. a vibration sensor, which further simplifies the installation. In one embodiment of the present disclosure at least one sensor switch may be configured to detect if a door or window is moved.

In a further embodiment of the present disclosure at least one sensor switch may be configured to detect a change of temperature. A sudden change of temperature, preferably placed adjacent to a building entrance, could be used to indicate that e.g. a door or window has been opened. Similarly, a sensor switch configured to detect a change of light could be used to indicate that e.g. a door or window has been opened if the sensor switch is placed in a void or cavity where there is no light. A sensor switch configured to detect a change of light also has the advantage that it may be capable of detecting other activities than just a door/window being opened/closed. An example is detection of an object approaching a building or indirect triggering through e.g. another independent motion sensor system that turns on lights based on motions.

In one embodiment of the invention at least one sensor switch is magnetically activated. This is the case with e.g. a Reed switch. The sensor assembly is preferably configured such that when the face of the sensor assembly containing the sensor switch is adjacent, aligned or flush with an actuation unit, e.g. a magnet, the sensor switch of the sensor assembly closes in the presence of the magnetic field between the sensor switch and the magnet, e.g. when the window is closed. The microprocessor monitors the state of the sensor switch. When the window is in the open position, e.g. due to an intruder, the magnetic field is removed, and the sensor switch opens, which in turn sends a signal to the wireless transmitter. The sensor switch in this embodiment may also use the opposite switching conditions i.e. the sensor switch of the sensor assembly opens in the presence of the magnetic field between the sensor switch and the magnet. The sensor switch in this embodiment may also be bistable, meaning it stays switched even after removal of the permanent magnet. The wireless transmitter may, in turn, transmit a signal which can be received by a receiving panel of an alarm system which may be configured to emit an alarm signal to indicate that the window has been opened.

The sensor assembly may further comprise means for connecting the components of the sensor assembly, e.g. for connecting the sensor switch, the microprocessor, the wireless transmitter and the power source, e.g. in the form a circuit structure, such as a PCB or a flexible circuit structure. The circuit structure may be rigid, semi-flexible or flexible. As a consequence, the sensor assembly may be at least partly flexible.

In one embodiment the antenna system comprises at least one antenna, such as a wire antenna. A matching network, also known as impedance matching network, may be provided in the antenna system. An impedance matching network is typically used to ensure that the wireless transmitter sees a fifty ohm antenna, thus the matching network basically transforms a wire antenna impedance to fifty ohm at the target frequency band. The impedance matching network may comprise inductors and capacitors.

In order to save power usage of the sensor assembly, the microprocessor may be configured to revert from an active mode to an idle mode, when not in use. Similarly, the microprocessor may be configured to revert from an idle mode to an active mode when detecting a change of state of a sensor switch. A similar functionality is described in U.S. Pat. No. 7,081,816 wherein a microprocessor is disclosed that is able to sample the state of a switch at select intervals and revert to an idle mode, i.e. the microprocessor samples the state of the switch, as opposed to continuous monitoring, in order to conserve the battery power. During the idle periods, the power drawn by the battery is negligible. Thus, battery life is extended several times over the anticipated life of the battery during continuous monitoring. In another embodiment, at least one (electrical) circuit configured to detect a change of state of a sensor switch, and wherein the circuit is connected between at least one sensor switch and the microprocessor. A change of electrical levels from the circuit when a sensor changes state, will trigger the CPU to move from a sleep/idle state to an active state. In that case the microprocessor does not sample the sensor switch at select intervals.

To further reduce power usage of the sensor assembly, at least one first power switch may be provided, that is configured to disconnect the power source from at least one sensor switch when the at least sensor switch is not in use.

Instead of changing the battery, the battery life may be extended by charging it by an external power source. Thus, the sensor assembly may be adapted for connection to an external power source for charging its internal power source. Thus, the sensor assembly may further comprise a second power switch and charging circuitry, and wherein the sensor assembly may be configured such that an external power source can charge the power source of the sensor assembly. The external power source may e.g. be a wired charger, a solar powered source, e.g. a solar cell, or a battery.

A sensor switch may be one of the thickest components of the sensor assembly. The sensor switch may therefore be located in a recess or dint in the circuit structure to minimize the height of the sensor assembly.

The antenna may be a wire, a chip or a printed circuit board antenna. There may be more than one antenna. In case of usage of the common free ISM bands, e.g. 433 and 868 MHz, for wireless transmission the antenna may be a wire antenna with a length of approx. 9 cm (868 MHz). For the 433 MHz band, the antenna may be as long as 18 cm. However, as the sensor assembly is elongated the antenna may be arranged to extend along the longitudinal direction of the elongated sensor assembly.

The sensor assembly may also be mounted in places that are exposed to outside weather conditions such as rain, dirt, moist, wind, heat and cold. The sensor assembly may therefore be moisture protected. For example, the sensor assembly may be laminated, or moulded in a polymer material, such that all the components are provided in a sealed package.

In yet another embodiment of the sensor assembly, a container may be provided for housing the components of the assembly. Thus, the form factor of the sensor assembly is determined by the container housing. The container may be provided to protect the components of the sensor assembly. The container may be moisture protected and/or sealed. For example, the container may be provided as an open elongated thin box and a lid with gaskets, or a lid (or bottom) possibly in the form of a sticker. The abovementioned circuit structure or PCB may form a lid of the container. Thus a thinner design can be achieved since the PCB/circuit structure replaces one side of the housing. Moreover, the circuit can easily be detached for repair or replacement. The lid may seal the container. To ensure easy installation of the sensor assembly at least a part of one side, e.g. the bottom side, of the elongated sensor assembly may have adhesive or provided with an adhesive, e.g. an adhesive sticker. Thereby the sensor assembly may be attached to a window or frame within seconds.

In another embodiment, the wireless transmitter may be configured for encrypted transmission of signals. Encryption may be provided to prevent unwanted interception of the signals and to prevent a third party to take control of the transmission between transmitter and receiver.

The sensor assembly may be provided with additional sensors and/or sensor options. For example, the sensor assembly may further comprise a light sensor configured to detect the level and/or a change of the ambient light conditions. A signal may be transmitted if nearby light is turned on or off. The sensor assembly may further comprise a temperature sensor configured to detect the level and/or a change in the ambient temperature. A signal may be transmitted if the temperature near the window changes, e.g. due to a broken window.

The sensor assembly may further comprise a humidity sensor configured to detect the level or a change in the ambient humidity. A signal may be transmitted if ventilation is necessary. The sensor assembly may further comprise a water sensor configured to detect the presence of water on the surface of the sensor assembly. A signal may be transmitted if a window is leaky or permeable. If the sensor assembly is mounted on top of the window blade it will be able to detect rain on an open window if provided with a water/rain sensor.

An additional sensor switch may be included in the sensor assembly to detect if someone tries to tamper with the sensor assembly. This second sensor switch may not be configured to detect the "normal" actuation unit when the window is closed, but may be placed in the sensor assembly to be configured to detect a foreign magnet adjacent to the sensor assembly and consequently transmit an alarm signal.

The sensor assembly may further comprise a motion sensor configured to detect movement adjacent to the sensor assembly. This feature of an alarm system allows detecting unlawful entrants. The sensor assembly may further comprise at least one accelerometer or vibration sensor configured to detect movement of the sensor assembly. In case someone tries to disable or move the sensor assembly.

The form factor of the sensor assembly may be critical for the ability to mount the assembly in the abovementioned voids and cavities. Thus, in a further embodiment of the invention, the maximum width of the sensor assembly is less than 40 mm, or less than 35 mm, or less than 30 mm, or less than 28 mm, or less than 26 mm, or less than 24 mm, or less than 22 mm, or less than 20 mm, or less than 18 mm, or less than 16 mm.

In order to reduce the height of the sensor assembly the power source (i.e. the internal power source) is preferably a battery with a thickness of less than or equal to 3 mm, 2.5 mm, 2 mm, 1.8 mm, 1.6 mm, 1.4 mm, 1.2 mm, 1 mm, 0.8 mm, 0.7 mm, 0.6 mm, 0.5 mm, or less than or equal to 0.4 mm. Lithium coin cell or button cell batteries may be used, a common variety being the 3 volt manganese variety, typically 20 mm in diameter and 1.6-3 mm thick. However, ultra-thin batteries are commercially available with a thickness of only 0.45 mm, which have an increased width compared to the coin cell batteries. However, they are commonly available with a width below 25 mm.

The present disclosure also relates to an alarm kit comprising the elongated sensor assembly as herein described and at least one actuation unit for actuating at least one sensor switch. At least one actuation unit preferably comprises a magnet, e.g. in the case of a reed switch. The actuation unit may be provided with an adhesive surface. In one embodiment the actuation unit may consist of a magnet or a magnet with an adhesive surface in order for easy mounting abilities. Thus, the actuation unit may simply be a piece of magnetic tape.

The actuation unit may also be installed in the abovementioned voids and cavities formed in windows and doors. Thus, a reduced height of the actuation unit may be preferred. Thus, in one embodiment the maximum height of the actuation unit may be less than 3 mm, or less than 2.5 mm, or less than 2 mm, or less than 1.5 mm, or less than 1 mm, or less than 0.8, or less than 0.6 mm, or less than 0.5 mm, or less than 0.4 mm, or less than 0.3 mm, or less than 0.2 mm, or less than 0.1 mm.

The presently disclosed sensor assembly is designed to be mounted in the voids and cavities formed between a door or window and the corresponding frame. Similarly, the alarm kit may be designed to be mounted in the voids and cavities formed between a door or window and the corresponding frame.

The alarm kit may be adapted to be mounted in an opening, void or cavity without modification of the opening, void or cavity, i.e. the physical size of the alarm kit may not require modification to e.g. a window frame. Furthermore, the alarm kit may not require tools for mounting and/or installation of the kit, thereby providing easy mounting and installation in an alarm system, and consequently avoiding the use of expensive technicians. The alarm kit may therefore be retrofitted (and removed without leaving traces or holes) to existing building entrances.

Thus, in another embodiment, the alarm kit may be adapted to be mounted on a window or window frame such that the alarm kit is located in a void formed between the window and the window frame when the window is closed. Further, the alarm kit may be adapted to be mounted on a door or door frame such that the alarm kit is located in a void formed between the door and the door frame when the door is closed. The sensor assembly may be mounted on the door/window and the actuation unit may consequently be mounted on the corresponding frame, or vice versa, i.e. the sensor assembly on the frame and the actuation unit on the window/door.

An additional actuation unit may be included in the alarm kit wherein the sensor assembly is configured to detect three different positions of the window: Open, closed and a third position where the window is slightly open for airing but still locked to prevent unlawful entry, thereby having a three state sensor assembly. Such a three state sensor assembly may e.g. be placed along the side of an awning window, where the window and frame are separated at the bottom of the window, and still adjacent further up, i.e. in position B in FIG. 6. Such sensor could e.g. comprise two Reed sensor switches and it may require one or two magnets for actuation. Reed switch #1 could e.g. be placed so it senses a magnet when the window is closed, but not in airing or open positions. Reed switch #1 could preferably be placed at the lower end of the window. Reed switch #2 could e.g. be placed in such a way that it senses the magnet in airing position, but not in open position. In order to sense the magnet in airing position, the switch/magnet could e.g. be placed further up on the window where the frame and window are still adjacent. The reed switch may or may not sense a magnet also in the closed position.

The height of the voids and cavities used for installation may be very limited and the sensor assembly, the actuation unit and/or the alarm may therefore be configured such that the sensor assembly and the actuation unit shall be located slightly laterally displaced relative to each other in a window or door system when the corresponding window or door is closed, i.e. the sensor assembly and the actuation unit is mounted slightly offset. I.e. they are still located adjacent to each other, but the actuation unit is possibly not located directly "on top" or "below" the sensor assembly in the void. Thus the actuation unit may then not add to the total height of the alarm kit.

In one embodiment, the thickness of a section of the elongated sensor assembly is less than 3 mm, or less than 2.5 mm, or less than 2 mm, or less than 1.5 mm, or less than 1 mm. In this embodiment, the section is thinner than other parts of the assembly. The advantage of having a thinner sector is that it can be used for sliding in an actuation unit (typically a magnet) for e.g. a reed sensor without increasing the total thickness of the sensor assembly and actuation unit. An example of this configuration is shown in FIG. 7*b*. The magnet 71 is not part of the sensor assembly, but may be placed opposite to the thinner section, with the possibility to slide it into the section to fit into the sensor assembly without making the total thickness larger. In one embodiment, the width of the section is at least 3 mm, or at least 3.5 mm, or at least 4.0 mm, or at least 4.5 mm, or at least 5.0 mm, or at least 5.5 mm, or at least 6.0 mm.

The present disclosure also relates to a wireless alarm system comprising one or more of the herein described elongated sensor assemblies and a wireless receiver configured to receive and process signals transmitted from the one or more sensor assemblies. The alarm system may further comprise a roll of magnetic tape, wherein a piece of the magnetic tape is suitable for actuating the sensor switch of the elongated sensor assemblies.

The present disclosure also relates to a wireless alarm system comprising one or more of the above described window alarm kits and a wireless receiver configured to receive and process signals transmitted from the sensor assemblies of the one or more window alarm kits.

DETAILED DESCRIPTION OF DRAWINGS

FIG. 1 shows the most basic components of an exemplary sensor assembly with the power source 11 connected to the microprocessor and wireless transmitter incorporated in a single chip 12. The integrated chip (IC) 13 connects to a Reed switch 14 and an antenna system 16. The IC may comprise RF transmitter, microprocessor, memory and clock. The IC may be provided with a plurality of GPIO's, such as 8 GPIO's, in order to be able to connect additional switches and sensors.

Figure 2:
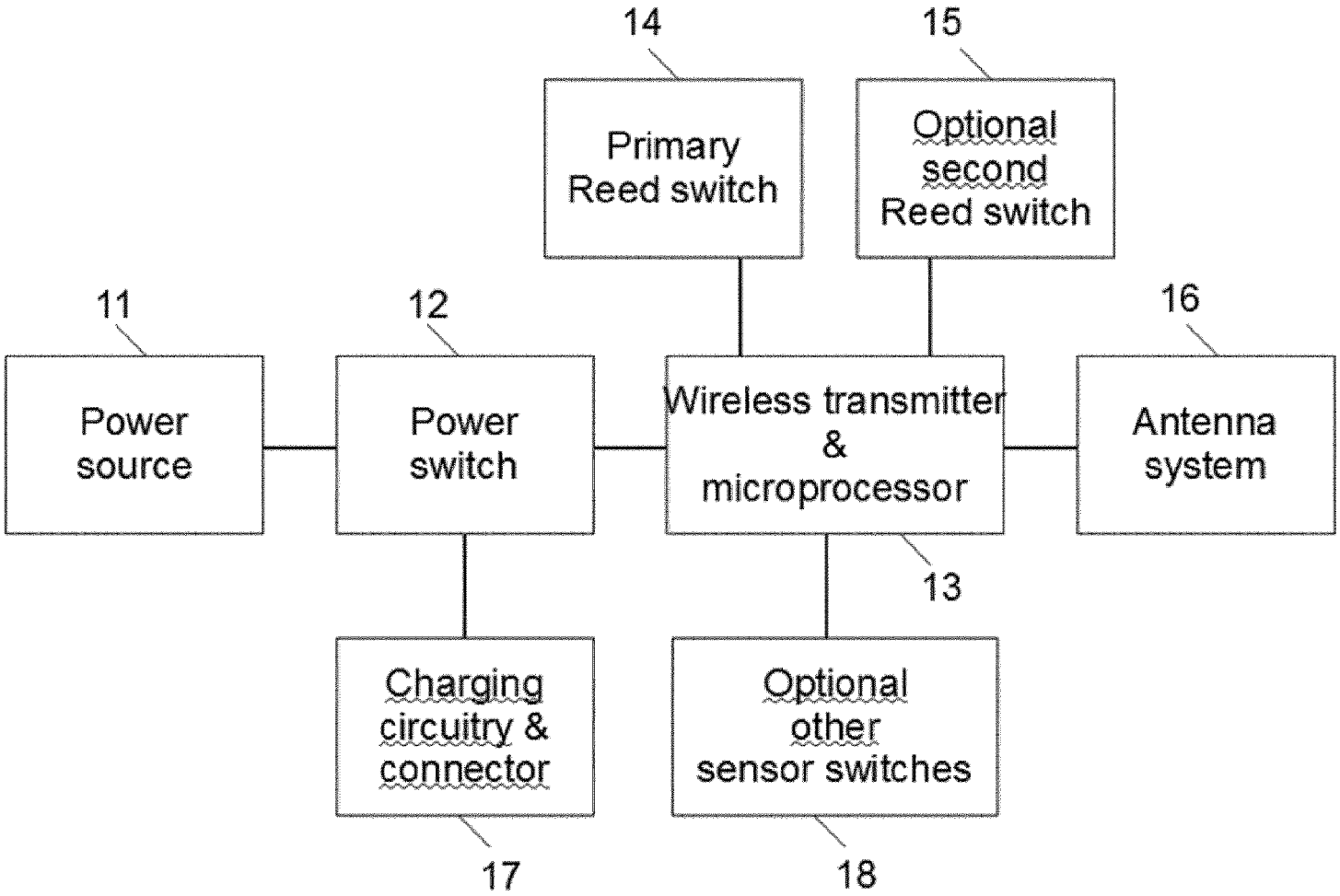
FIG. 2 shows another a block diagram of an exemplary sensor assembly with various optional features.

FIG. 2 shows the exemplary sensor assembly from FIG. 1 with additional optional features. A power switch 12 with charging circuitry and processor 17 is inserted between the power source 11 and the chip 13 to provide for possible charging of the power source. An additional Reed switch 15 is provided in parallel to the primary Reed switch 14 in order to detect other state changes, i.e. additional positions of a door/window. Any additional sensor switches 18 (temperature, acceleration, movement, humidity, etc.) may be connected to the chip 18.

Figure 3:
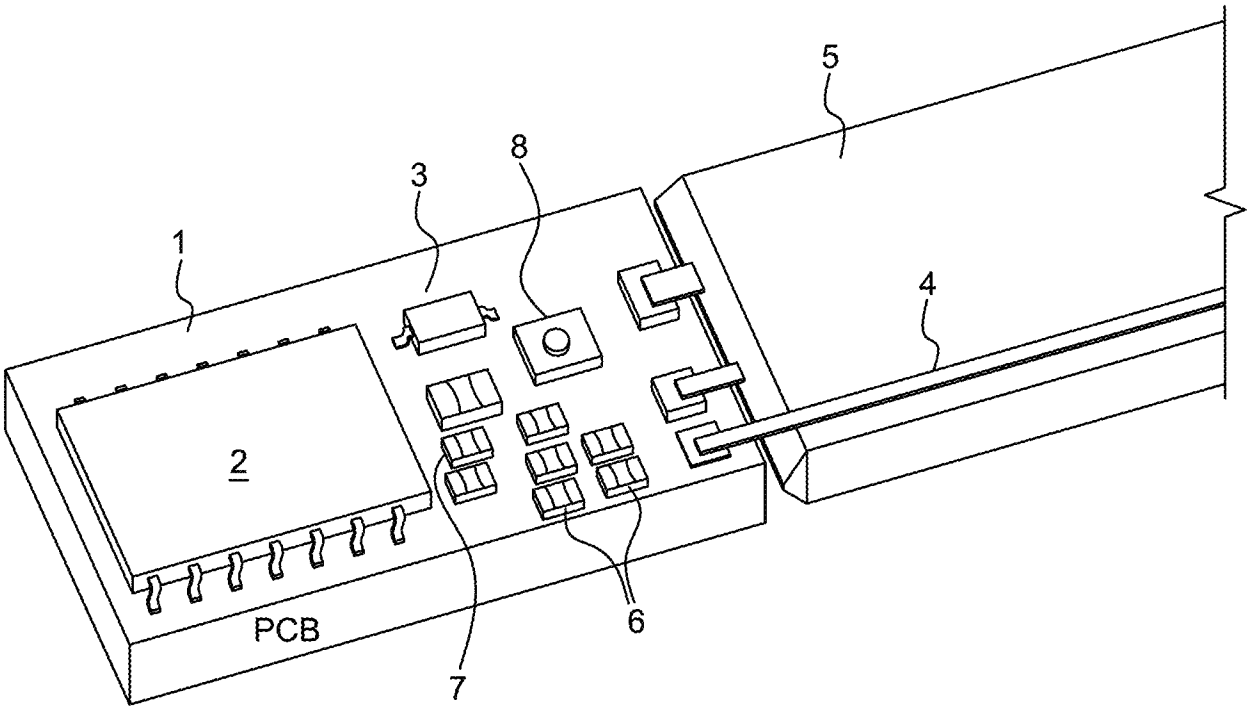
FIG. 3 is a perspective view of an exemplary sensor assembly with a thin elongated form factor.

FIG. 3 is an exemplary illustration of how to incorporate the components of an exemplary sensor assembly to a thin elongated form factor. A thin PCB holds the chip 2 (microprocessor+transmitter), Reed switch 3, antenna matching network 6, decoupling components 7 and power switch 8. Next to the PCB the battery 5 is provided as an extension and the antenna is extending in the longitudinal direction of the sensor assembly. Thus, the sensor assembly may be realized to have a thin and elongated form factor.

Figure 4A:
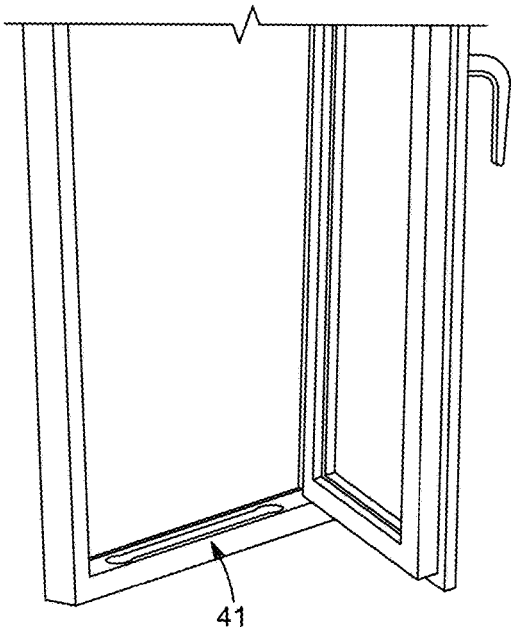
FIG. 4*a* shows a casement window that is open and with an exemplary slim and elongated sensor assembly installed on the bottom of the inside surface of the window frame.
Figure 4B:
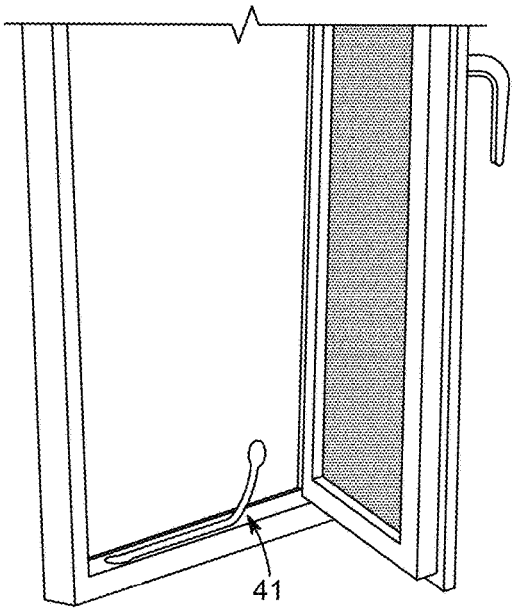
FIG. 4*b* illustrates the slimness and flexibility of the sensor assembly of FIG. 1.

FIG. 4*a* shows a casement window that is open and with an exemplary slim and elongated sensor assembly 41 as described herein installed on the bottom of the inside surface of the window frame. FIG. 4*b* illustrates the slimness and possible flexibility of the sensor assembly 41 of FIG. 1.

Figure 4C:
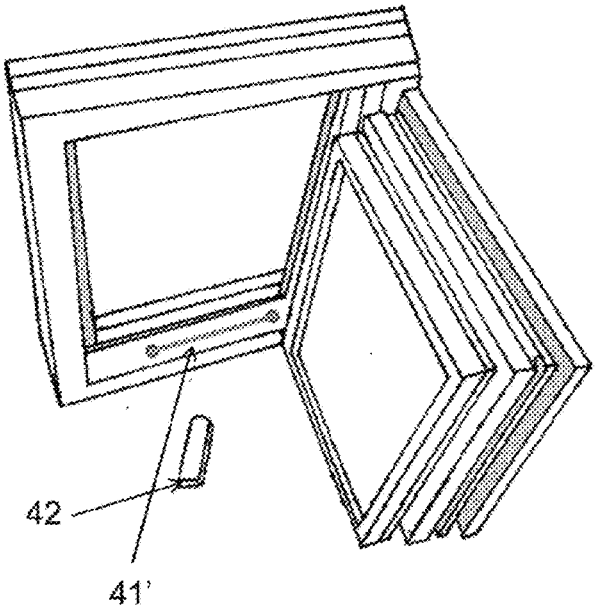
FIG. 4*c* is a perspective view of a mock-up of another slim elongated sensor assembly installed in the bottom of the inside surface of a casement frame and a prior art sensor assembly is lying in front of the casement window for comparison.

FIG. 4*c* is a photo of a mock-up of another slim elongated sensor assembly 41 installed in the bottom of the inside surface of a casement frame. A commercially available prior art wireless sensor assembly is lying in front of the casement window for comparison. This prior art sensor assembly is to be mounted directly on the window frame with a magnet on the window flush with the assembly. As seen from FIG. 4*c* this bulk assembly is not aesthetically appealing, and when installed on a window frame it will often be visible from the outside, i.e. unlawful entrants will be able to see the sensor assembly. The sensor assembly as herein disclosed will not be visible to occupiers as well as burglars.

Figure 4D:
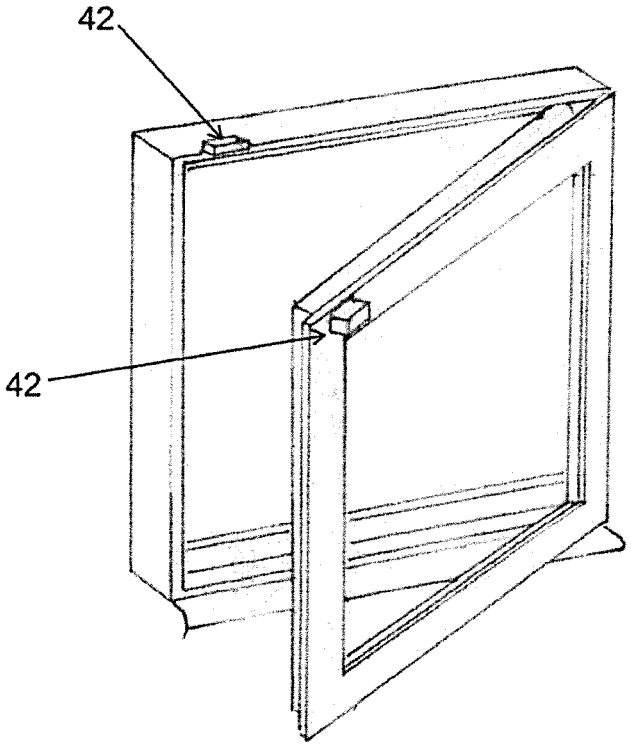
FIG. 4*d* shows a prior art window alarm installed on the outside of a casement frame and a magnet for actuating the window alarm on the outside of a window frame.

FIG. 4*d* shows an example of a prior art window alarm installed on the outside of a casement frame and the magnet placed on the outside of a window frame. In this example both parts of the retrofitted window alarm are mounted visibly.

Figure 5A:
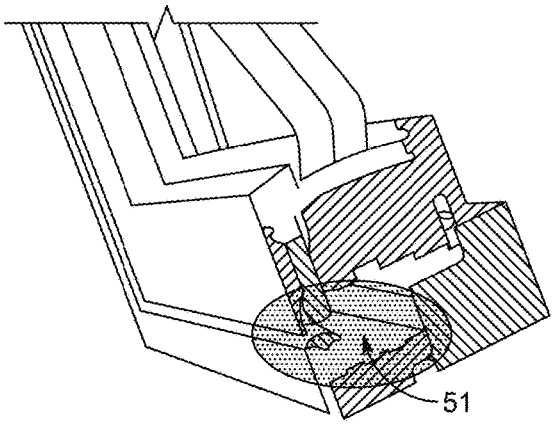
FIG. 5*a* is a cut-out illustration of a closed triple glazed casement window.
Figure 5B:
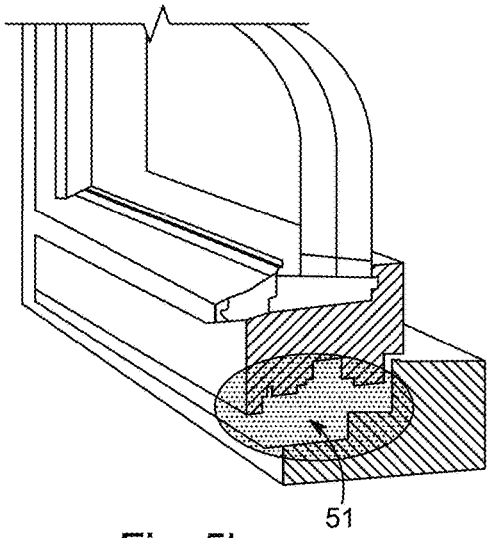
FIG. 5*b* is a cut-out illustration of another closed triple glazed casement window.
Figure 5C:
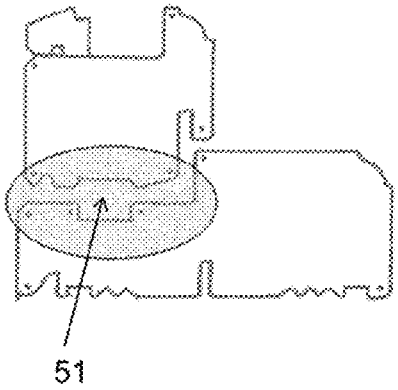
FIG. 5*c* is a side-view cut-out illustration of a casement window in closed position.

FIGS. 5*a* and 5*b* are cut-out illustrations of closed triple glazed casement windows. The cross-section of the elongated void/cavity 51 formed between the window and the frame is highlighted with an ellipse. FIG. 5*c* is a technical drawing showing a side-view cut-out illustration of a casement window in a closed position. The void/cavity 51 is also clearly visible in FIG. 5*c*. The presently disclosed elongated sensor assembly and alarm kit is preferably adapted and designed to be mounted in such a void/cavity 51.

Figure 6:
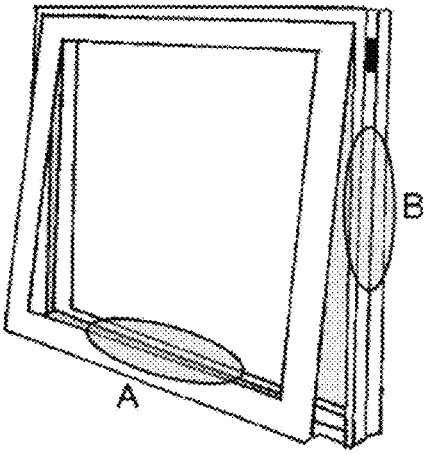
FIG. 6 illustrates an awning window with exemplary mounting locations "A" and "B"

FIG. 6 illustrates an awning window with indications of exemplary mounting locations A and B of the presently disclosed alarm kit.

Figure 7A:
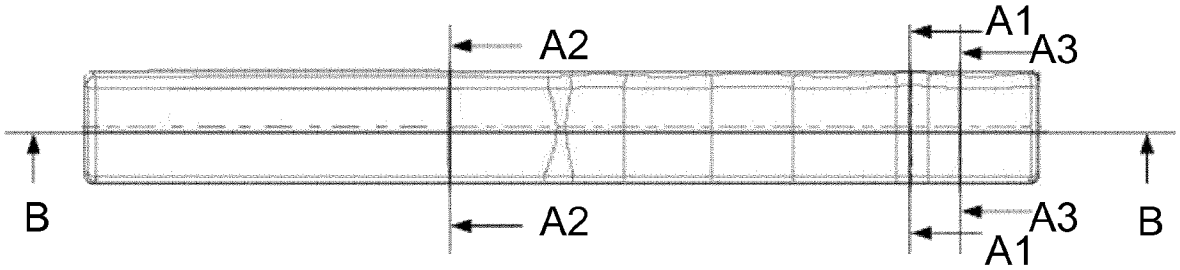
FIG. 7*a* shows a top view of an embodiment of the sensor assembly.
Figure 7B:
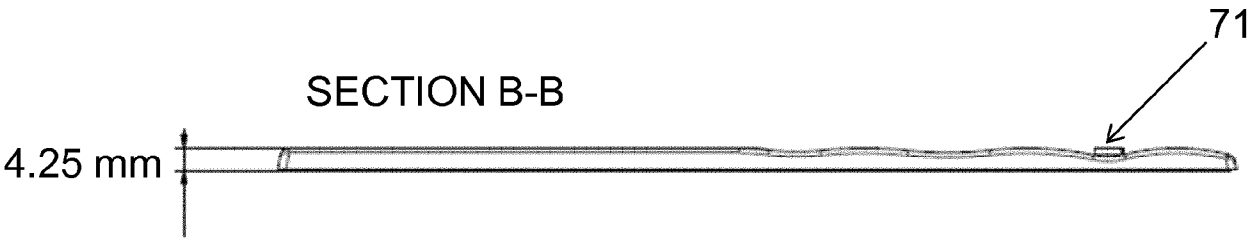
FIG. 7*b* shows a longitudinal section of the sensor assembly and a magnet (not attached to the assembly)

FIG. 7*a* shows a top view of an embodiment of the presently disclosed sensor assembly. The width of the assembly is approximately 15 mm and the approximate length is 200 mm. The assembly has a plastic cover. The top view is intended to give an example of external dimensions and point out the location of the cross-sections B-B, A1-A1, A2-A2, and A3-A3 of FIG. 7*b*-7*e*.

FIG. 7*b* shows a longitudinal section of an embodiment of the sensor assembly, section B-B. The height (thickness) of the assembly in the example is 4.25 mm. A magnet 71 is placed outside the plastic cover. The magnet (actuation unit)

is not attached to the assembly in this configuration. The example illustrates how the magnet is placed in a recessed position in terms of total height of the assembly and magnet. In this example the magnet is not attached to the assembly but typically on e.g. the casement frame of the window. When the window (or door) is closed the magnet slides into the lower section of the assembly from the side.

Figure 7C:
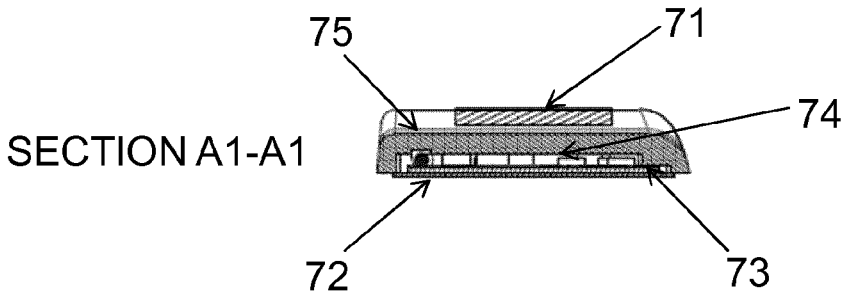
FIG. 7*c* shows a cross-section across A1-A1 as shown in FIG. 7*a;*

FIG. 7*c* shows a cross-section of an embodiment of the sensor assembly, section A1-A1 at the magnet 71, which is located on the upper side of the plastic cover 75. In this assembly, the plastic cover is glued on top of the PCB to form a moisture protected unit. An adhesive tape is mounted on the PCB for simple installation in the window or door void.

Figure 7D:
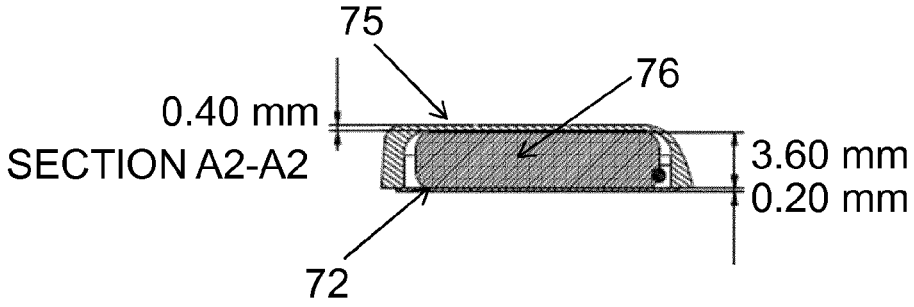
FIG. 7*d* shows a cross-section across A2-A2 as shown in FIG. 7*a;*

FIG. 7*d* shows a cross-section of an embodiment of the sensor assembly, section A2-A2 at the battery 76. The example illustrates possible heights (thickness) of the different layers of the assembly. At this cross-section, the thickness of the battery 76 is 3.60 mm, the upper plastic cover 75 0.40 mm, and the lid 72 0.20 mm.

Figure 7E:
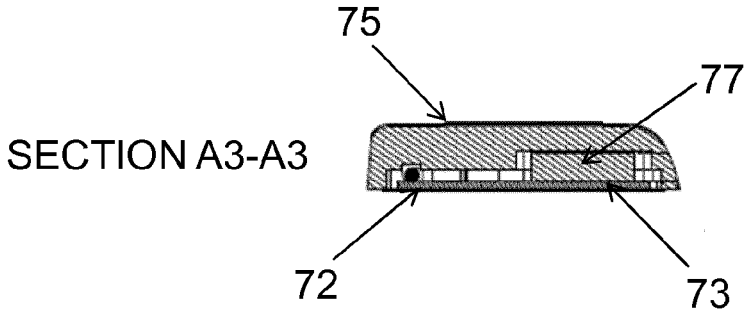
FIG. 7*e* shows a cross-section across A3-A3 as shown in FIG. 7*a*.

FIG. 7*e* shows a cross-section of an embodiment of the sensor assembly, section A3-A3. In addition to the lid 72, the printed circuit board 73 and the plastic cover 75, the figure shows a cross-section of a magnetically activated sensor 77.

Figure 8:
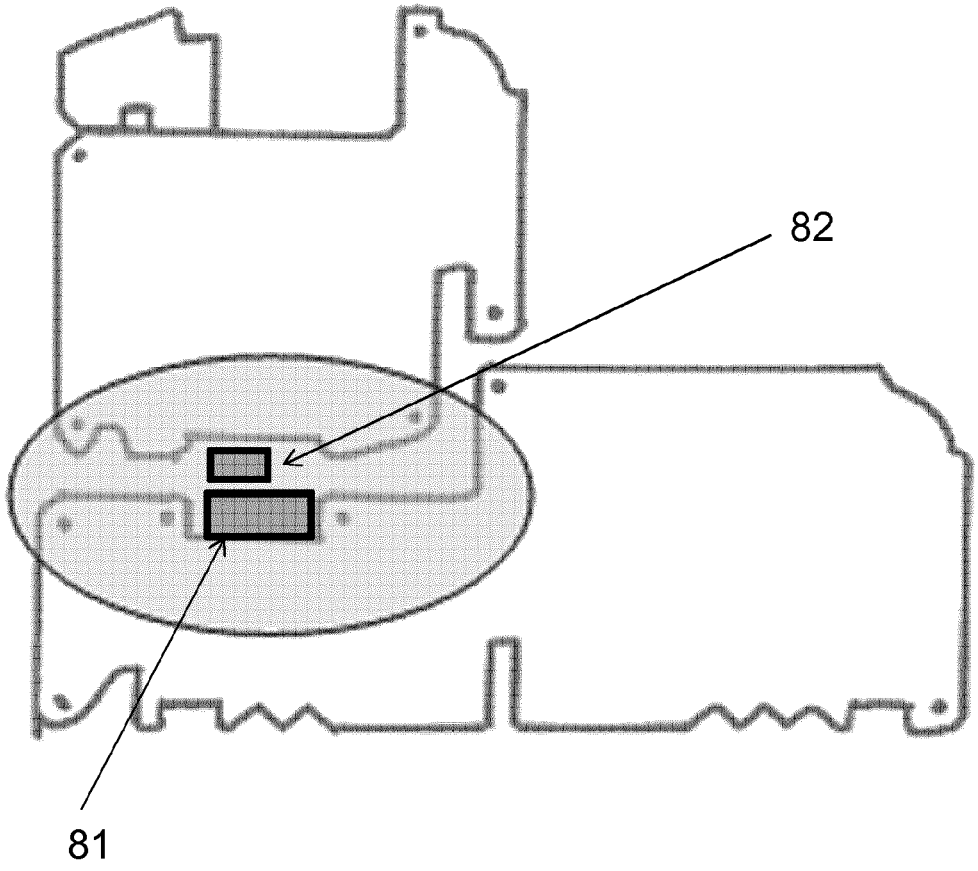
FIG. 8 shows another cut-out illustration of a casement window in closed position.

FIG. 8 shows a side-view cut-out illustration of a casement window in closed position with an embodiment of the presently disclosed sensor assembly and a magnet for actuating the sensor. In the example the sensor assembly 81 is attached to the frame, and the magnet 82 is attached to the window.

The invention claimed is:

1. An elongated sensor assembly for a wireless alarm system for detecting a change of state, comprising:

at least one sensor switch configured to detect a given state and a change of state between the given state and at least one other state;

a microprocessor configured to detect the change of state of the at least one sensor switch;

an antenna system;

a wireless transmitter configured to receive a signal from the microprocessor identifying the change of state of the at least one sensor switch and transmit the signal by the antenna system;

a thin power source for providing electric power to the microprocessor, the at least one sensor switch, and the wireless transmitter; and a circuit structure having a generally flat surface, wherein the at least one sensor switch, the microprocessor, the antenna system, the wireless transmitter, and the thin power source are each disposed on the generally flat surface of the circuit structure such that the elongated sensor assembly has a thin and elongated form factor with a maximum height of less than 5 mm wherein the elongated sensor assembly further comprises a sensor selected from the group consisting of;

a light sensor configured to detect a level and/or a change of an ambient light condition and operable to transmit a signal if a nearby light is turned on or off;

a temperature sensor configured to detect a level and/or a change of ambient temperature and operable to transmit a signal if a temperature near a window changes due to a broken window; and a humidity sensor configured to detect a level or a change in an ambient humidity and operable to transmit a signal if ventilation is necessary.

2. The elongated sensor assembly according to claim 1, wherein the at least one sensor switch is a magnetically activated reed switch.

3. The elongated sensor assembly according to claim 1, wherein the at least one sensor switch is configured to detect whether a window or door is open or closed.

4. The elongated sensor assembly according to claim 1, wherein the at least one sensor switch is configured to detect a change of position of an object.

5. The elongated sensor assembly according to claim 4, wherein the object is a door or a window.

6. The elongated sensor assembly according to claim 1, wherein the at least one sensor switch is configured to detect an opening and/or closure of a door or window.

7. The elongated sensor assembly according to claim 1, wherein the at least one sensor switch is configured to detect a change of temperature.

8. The elongated sensor assembly according to claim 1, wherein the at least one sensor switch is configured to detect a change of light.

9. The elongated sensor assembly according to claim 1, wherein the at least one sensor is a vibration sensor, acceleration sensor, motion sensor, magnetoresistive sensor, or proximity sensor.

10. The elongated sensor assembly according to claim 1, wherein the maximum height of the sensor assembly is less than 3.5 mm.

11. The elongated sensor assembly according to claim 1, wherein the thin and elongate power source is a battery with a thickness of less than 2.5 mm.

12. The elongated sensor assembly according to claim 1, wherein the at least one sensor switch is located in a recess or dint in the circuit structure.

13. The elongated sensor assembly according to claim 1, wherein the circuit structure is a Printed Circuit Board (PCB).

14. The elongated sensor assembly according to claim 1, further comprising at least one circuit configured to detect a change of state of the at least one sensor switch, and wherein the microprocessor is configured to revert from an idle mode to an active mode when detecting a change of electrical level of the circuit, and wherein the microprocessor is configured to revert from an active mode to an idle mode when not in use.

15. The elongated sensor assembly according to claim 1, further comprising at least one first power switch configured to disconnect the thin and elongate power source from the at least one sensor switch when the at least one sensor switch is not in use, and at least one second power switch and a charging circuitry, wherein the thin and elongate power source is configured to be charged by an external power source.

16. The elongated sensor assembly according to claim 1, wherein the elongated sensor assembly is adapted to be mounted on a surface without penetrating or piercing the surface and at least a part of a side of the elongated sensor assembly has an adhesive surface.

17. The elongated sensor assembly according to claim 1, wherein the elongated sensor assembly is adapted to be mounted on an outside surface of a window, window frame, door or door frame, such that the elongated sensor assembly is located in a void formed between a window and a corresponding window frame when the window is closed, or located in a void formed between a door and a corresponding door frame when the door is closed.

18. A wireless alarm system comprising:

one or more of the elongated sensor assemblies according to claim 1; and a wireless receiver configured to receive and process signals transmitted from the one or more sensor assemblies.

19. The wireless alarm system according to claim 18, further comprising at least one actuation unit for actuating the sensor switch and the actuation unit comprising at least one adhesive surface.

20. The wireless alarm system according to claim 19, wherein the actuation unit is a piece of magnetic tape.

21. The elongated sensor assembly according to claim 1, wherein the thickness of a section of the elongated sensor assembly is less than 3 mm, or less than 2.5 mm, or less than 2 mm, or less than 1.5 mm, or less than 1 mm.

22. The elongated sensor assembly according to claim 21, wherein the width of the section is at least 3 mm, or at least 3.5 mm, or at least 4.0 mm, or at least 4.5 mm, or at least 5.0 mm, or at least 5.5 mm, or at least 6.0 mm.

23. The elongated sensor assembly according to claim 1, wherein the thin power source is disposed next to the at least one sensor switch, the microprocessor, and the wireless transmitter.

24. A method for providing a wireless alarm sensor for a building entrance of the type having a frame portion and a window portion, and an elongated-narrow void defined between the frame portion and the window portion when the building entrance is closed, the method comprising:

providing an elongated sensor assembly comprising:

a circuit structure having a generally flat surface;

at least one sensor switch disposed on the generally flat surface of the circuit structure, and configured to detect a given state and a change of state between the given state and at least one other state;

a microprocessor disposed on the generally flat surface of the circuit structure and configured to detect the change of state of the at least one sensor switch; an antenna system disposed on the generally flat surface of the circuit structure;

a wireless transmitter disposed on the generally flat surface of the circuit structure, and configured to receive a signal from the microprocessor identifying the change of state of the at least one sensor switch and transmit the signal by the antenna system; and a thin power source disposed on the generally flat surface of the circuit structure for providing electric power to the microprocessor, the at least one sensor switch, and the wireless transmitter, wherein the circuit structure, the at least one sensor switch, the microprocessor, the antenna system, and the wireless transmitter are incorporated in the elongated sensor assembly such that the elongated sensor assembly has a thin and elongated form factor with a maximum height of less than 5 mm;

mounting the elongated sensor assembly in the elongated-narrow void of the building entrance without modifying the frame portion or the window portion; and providing a receiving panel to receive the transmitted signal of the antenna system identifying the change of state of the at least one sensor switch and receiving the transmitted signal in the receiving panel;

wherein the elongated sensor assembly further comprises a sensor selected from the group consisting of;

a light sensor configured to detect a level and/or a change of an ambient light condition and operable to transmit a signal if a nearby light is turned on or off;

a temperature sensor configured to detect a level and/or a change of ambient temperature and operable to transmit a signal if a temperature near a window changes due to a broken window; and a humidity sensor configured to detect a level or a change in an ambient humidity and operable to transmit a signal if ventilation is necessary.

25. The method according to claim 24, wherein the building entrance is a door or a window.

* * * * *